US008657408B2

(12) United States Patent
Ito et al.

(10) Patent No.: US 8,657,408 B2
(45) Date of Patent: Feb. 25, 2014

(54) IMAGE RECORDING APPARATUS

(71) Applicant: Brother Kogyo Kabushiki Kaisha, Aichi-Ken (JP)

(72) Inventors: Atsushi Ito, Nagoya (JP); Takashi Yoshikawa, Kasugai (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 13/758,032

(22) Filed: Feb. 4, 2013

(65) Prior Publication Data

US 2013/0257981 A1 Oct. 3, 2013

(30) Foreign Application Priority Data

Mar. 30, 2012 (JP) ..... 2012-079115

(51) Int. Cl.
*B41J 23/00* (2006.01)

(52) U.S. Cl.
USPC ..... 347/37; 347/16; 347/40; 347/41

(58) Field of Classification Search
USPC ..... 347/9–12, 15, 16, 20, 37, 40–43, 50, 57
See application file for complete search history.

(56) References Cited

U.S. PATENT DOCUMENTS 6,846,065 B2 * 1/2005 Otsuki ..... 347/40
7,510,254 B2 * 3/2009 Yun et al. ..... 347/15

FOREIGN PATENT DOCUMENTS

JP 2010-162804 7/2010

* cited by examiner

*Primary Examiner* — Thinh Nguyen
(74) *Attorney, Agent, or Firm* — Frommer Lawrence & Haug LLP

(57) ABSTRACT

An image recording apparatus includes an ink-jet head having a plurality of nozzles and configured to jet ink droplets from the nozzles; a carriage configured to carry the ink-jet head, and reciprocate in a predetermined scanning direction; a transport mechanism configured to transport the recording medium, on which the ink droplets jetted from the nozzles land, in a transport direction intersecting the scanning direction; and a control device configured to control the ink-jet head, the carriage and the transport mechanism to perform recording of the image. The nozzles include a plurality of first nozzles which are aligned at first interval with respect to the transport direction and from which first-type ink droplets are jetted, and a plurality of second nozzles which are aligned at second interval with respect to the transport direction and from which second-type ink droplets different from the first-type ink droplets are jetted.

5 Claims, 16 Drawing Sheets

IMAGE RECORDING APPARATUS

CROSS REFERENCE TO RELATED APPLICATION

The present invention claims priority from Japanese Patent Application No. 2012-079115, filed on Mar. 30, 2012, the disclosure of which is incorporated herein by reference in its entirety.

BACKGROUND OF THE INVENTION

1. Field of the Invention

The present invention relates to an image recording apparatus which performs image recording on a recording medium.

2. Description of the Related Art

Japanese Patent Application Laid-Open No. 2010-162804 discloses an image formation apparatus which performs image recording by an ink-jet head which jets ink from nozzles while reciprocating in a scanning direction. In the ink-jet head disclosed in Japanese Patent Application Laid-Open No. 2010-162804, black nozzles are aligned at intervals which are half of intervals of color nozzles. When both black ink and color inks are used to perform image recording, a series of operations are repeatedly carried out. That is, the ink-jet head is moved in the scanning direction while jetting the inks from the black and color nozzles, and then recording paper is transported by the length of five intervals of the black nozzles.

In this case, in the ink-jet head disclosed in Japanese Patent Application Laid-Open No. 2010-162804, the black nozzles are arranged such that they are divided into two black nozzle groups and, on each timing of ink-jetting, the ink is jetted alternately from the black nozzles belonging to one of the two groups and from the black nozzles belonging to the other. By carrying out image recording in this manner, while moving the ink-jet head once in the scanning direction, all of the black nozzles have a chance to jet the ink, and hence it is possible to prevent the black nozzles from drying.

In the image formation apparatus disclosed in Japanese Patent Application Laid-Open No. 2010-162804, such a case is conceivable as recording a straight line extending in a direction perpendicular to the scanning direction. In a case that such a line is recorded by using the image formation apparatus disclosed in Japanese Patent Application Laid-Open No. 2010-162804, as will be described hereinafter, the dots forming the line become smaller, and thus light line is recorded.

Further, in the ink-jet head disclosed in Japanese Patent Application Laid-Open No. 2010-162804, the black nozzles are aligned at intervals which are half of the intervals of the color nozzles. However, for the purpose of raising the speed of recording black-and-white images, it is also conceivable to further reduce the interval between the black nozzles so as to align the color nozzles at intervals each of which is not less than three times and an odd multiple of each of the intervals of the black nozzles. Then, in such cases, the dots forming a straight line become even smaller, and thus the line is recorded more lightly.

SUMMARY OF THE INVENTION

An object of the present invention is to provide an image recording apparatus capable of darkly recording straight lines extending in a direction perpendicular to the scanning direction while preventing the nozzles from drying.

According to an aspect of the present invention, there is provided an image recording apparatus configured to perform recording an image on a recording medium by jetting a plurality of types of ink droplets, the apparatus including: an ink-jet head having a plurality of nozzles and configured to jet the ink droplets from the nozzles; a carriage configured to carry the ink-jet head, and reciprocate in a predetermined scanning direction; a transport mechanism configured to transport the recording medium, on which the ink droplets jetted from the nozzles land, in a transport direction intersecting the scanning direction; and a control device configured to control the ink-jet head, the carriage and the transport mechanism to perform recording of the image, wherein the ink-jet head has, as the plurality of nozzles, a plurality of first nozzles which are aligned at first interval with respect to the transport direction and from which first-type ink droplets are jetted, and a plurality of second nozzles which are aligned at second interval with respect to the transport direction and from which second-type ink droplets different from the first-type ink droplets are jetted, the second interval being predetermined odd number times as long as the first interval and the predetermined odd number being not less than three, the first nozzles are divided into the predetermined odd number of nozzle groups each of which is constituted by some of the first nozzles aligned at the second interval in the transport direction, the control device is configured to perform recording of the image on the recording medium by performing a first unit recording operation for the predetermined odd number of times repeatedly, the first unit recording operation being a series of operations of jetting the ink droplets from the first nozzles constituting one nozzle group among the predetermined odd number of nozzle groups and from the second nozzles while moving the carriage in the scanning direction, and causing the transport mechanism to transport the recording medium by predetermined length, which is one of the length of the first interval and length obtained by adding an integral multiple of the second interval to the first interval, and in two successive performances of the first unit recording operation, after the first-type ink droplets are jetted in former first unit recording operation from a first nozzle group among the predetermined odd number of nozzle groups, the first-type ink droplets are jetted in latter first unit recording operation from a second nozzle group among the predetermined odd number of nozzle groups, the second nozzle group including the first nozzles arranged at positions which are deviated by twice the first interval to the downstream side in the transport direction from the first nozzles belonging to the first nozzle group, and landing positions of the first-type ink droplets jetted in the latter first unit recording operation are deviated by the first interval to the downstream side in the transport direction from landing positions of the first-type ink droplets jetted in the former first unit recording operation.

In the image recording apparatus according to the above aspect of the present invention, because the first nozzles are aligned at a density which is a predetermined odd number times and not less than three times as high as a density of the second nozzles, all the first nozzles constituting the nozzle groups have a chance to jet the ink droplets at least once when the first unit recording operation is repeated for the predetermined odd number of times. Accordingly, it is possible to restrain the numerous first nozzles from being dried.

Further, in the image recording apparatus according to the above aspect of the present invention, for example, when recording a straight line on the recording medium by repeating the first unit recording operation to let a plurality of sets of dots aligned in the scanning direction be aligned in the transport direction, the sets of dots aligned in the scanning direction are formed by the ink droplets jetted successively from the same first nozzles in each of the first unit recording operations. Therefore, in each of the first unit recording operations, after jetting the ink droplets from some first nozzles, it is less likely to have a long time until the ink droplets are jetted next from those first nozzles. Hence, the ink in the first nozzles is less dryable, thereby increasing the mean volume of the ink droplets jetted from the first nozzles. As a result, the straight line becomes darker, thereby making it possible to increase the visibility of the straight line in the recorded image.

DESCRIPTION OF THE PREFERRED EMBODIMENT

Hereinbelow, a preferred embodiment of the present invention will be explained.

Figure 1:
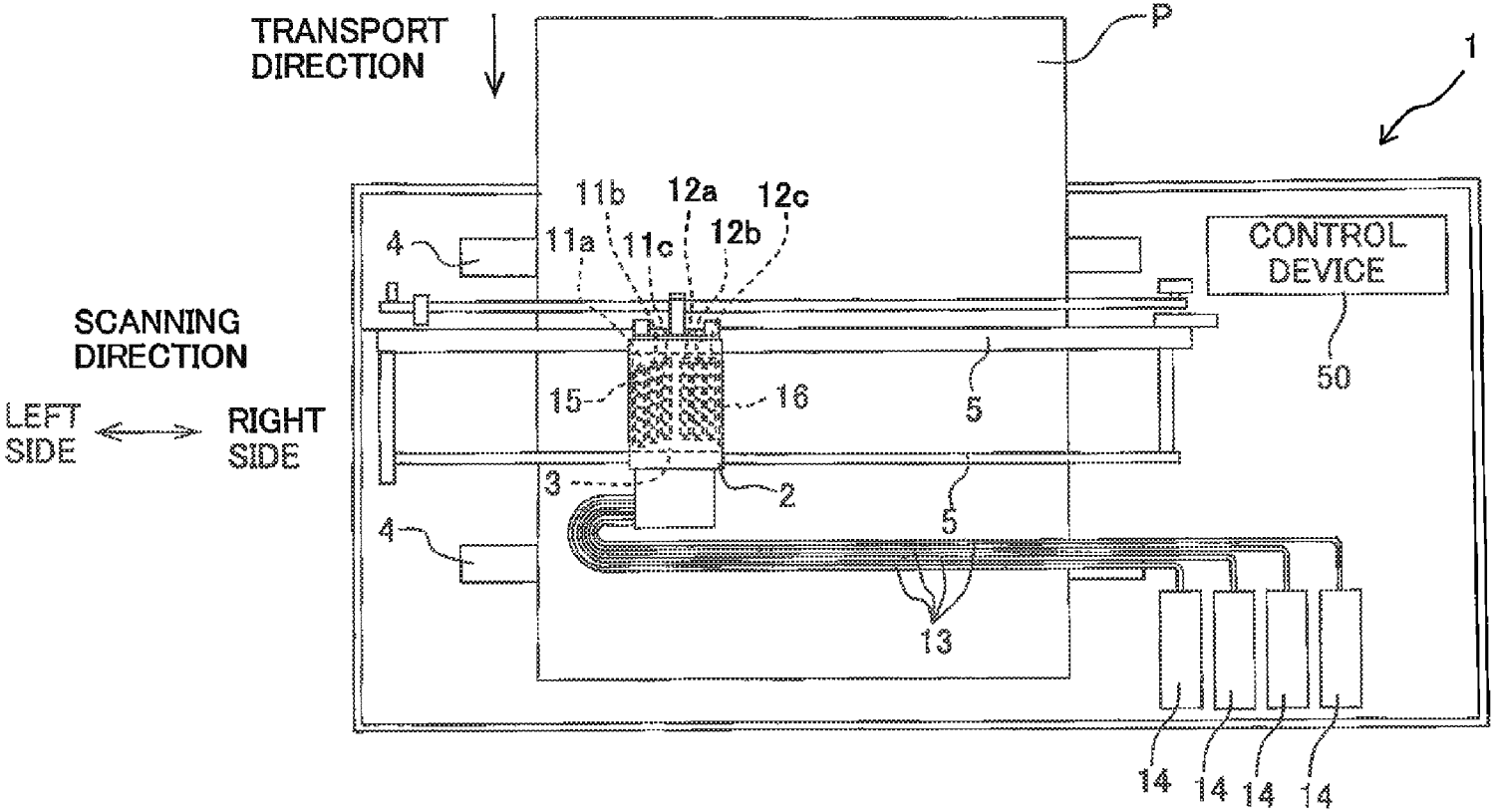
FIG. 1 is a schematic configuration diagram of a printer according to an embodiment of the present invention.
Figure 2:
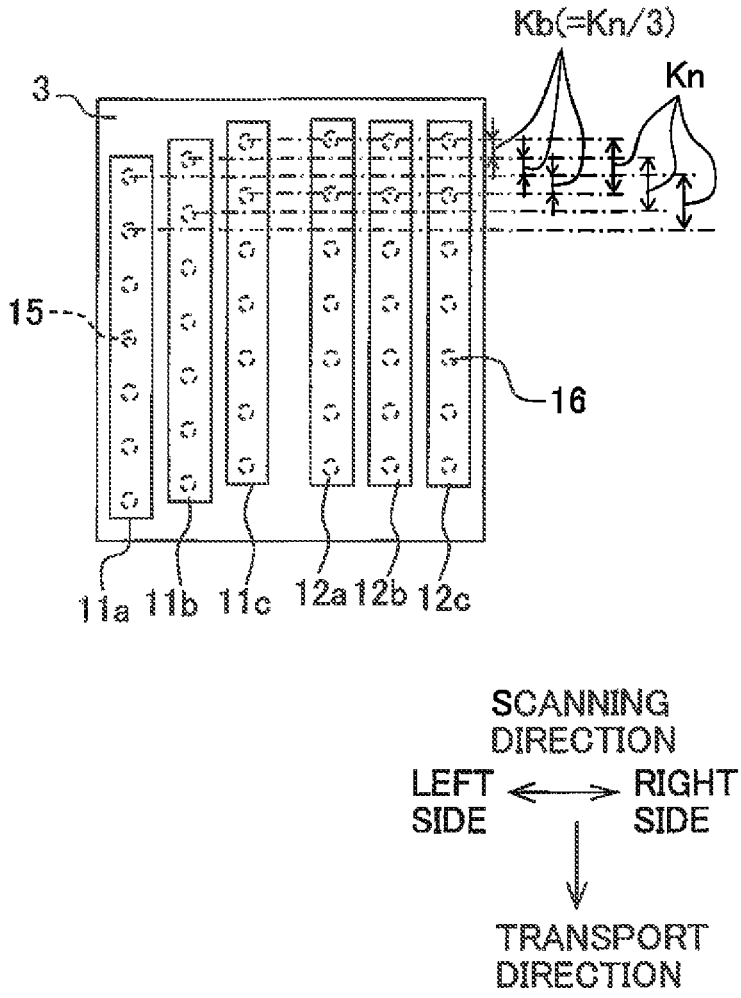
FIG. 2 shows a positional relationship between nozzles of an ink-jet head of the printer of FIG. 1.

As shown in FIG. 1, a printer 1 in accordance with the embodiment includes a carriage 2, an ink-jet head 3, paper transport rollers 4, and the like. Further, a control device 50 controls operation of the printer 1.

The carriage 2 reciprocates along two guide rails 5 in a scanning direction. Further, in the following explanations, the right side and the left side in the scanning direction are defined as those shown in FIG. 1. The ink-jet head 3 includes three black head units 11*a* to 11*e*, and three color head units 12*a* to 12*c*.

The three black head units 11*a* to 11*c* are arranged along the scanning direction, and each include a plurality of black nozzles 15 aligned at an interval Kn between each other in a transport direction perpendicular to the scanning direction. Further, the black head unit 11*b* is arranged to deviate by an interval Kb which is one third of the interval Kn (=Kn/3) from the black head unit 11*a* to the upstream side in the transport direction, and the black head unit 11*c* is arranged to deviate by the interval Kb from the black head unit 11*b* to the upstream side in the transport direction. By virtue of this, in the ink-jet head 3, the black nozzles 15 are aligned at the intervals Kb with respect to the transport direction.

In the embodiment, as described above, by arranging the three black head units 11*a* to 11*c*, in each of which the black nozzles 15 are aligned at the interval Kn between each other, to deviate by the interval Kb one after another in the transport direction, the black nozzles 15 are consequently aligned at the intervals Kb. However, instead of the three black head units 11*a* to 11*c*, it is also possible to provide one black head unit in which the black nozzles 15 are aligned at the interval Kb between each other.

The three color head units 12*a* to 12*c* are arranged along the scanning direction, and each includes a plurality of color nozzles 16 aligned at the interval Kn between each other in the transport direction perpendicular to the scanning direction. Further, the three color head units 12*a* to 12*c* do not deviate from each other in the transport direction, and the color nozzles 16 of the three color head units 12*a* to 12*c* are positioned at the same positions as the black nozzles 15 of the black head unit 11*c* with respect to the transport direction.

Further, the ink-jet head 3 is connected with four ink cartridges 14 through tubes 13. The four ink cartridges 14 store inks of black, yellow, cyan and magenta in the order of their arrangement from the right side in the scanning direction, and the inks of these four colors are supplied to the ink-jet head 3 through the tubes 13.

Then, the ink-jet head 3 jets the four color inks supplied from the ink cartridges 14. In particular, the black ink is jetted from the black nozzles 15 of the black head units 11*a* to 11*c*, and the yellow, cyan and magenta inks are jetted respectively from the color nozzles 16 of the color head units 12*a* to 12*e* according to this order.

The paper transport rollers 4 transport sheets of recording paper P in the transport direction. Then, the printer 1 performs image recording on the recording paper P by jetting the inks from the ink-jet head 3 moving along with the carriage 2 to the right side and the left side, onto the recording paper P transported by the paper transport rollers 4 in the transport direction.

Figure 3:
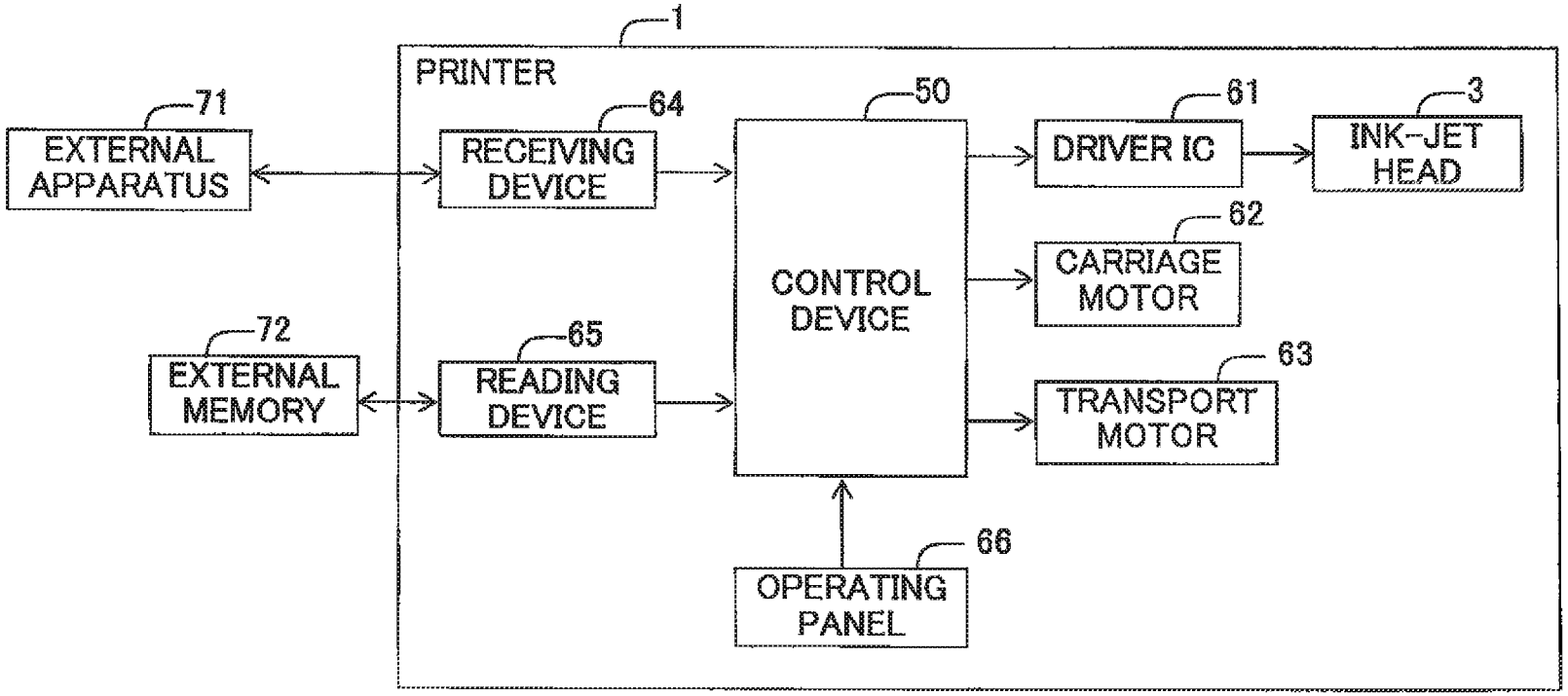
FIG. 3 is a hardware block diagram showing a hardware configuration of the printer according to the embodiment.

Next, referring to FIG. 3, a hardware configuration of the printer 1 will be explained. As shown in FIG. 3, the printer 1 includes the control device 50, a driver IC 61, a carriage motor 62, a transport motor 63, the ink-jet head 3, a receiving device 64, reading device 65, and an operating panel 66.

The receiving device 64 may be an interface for receiving various data sent from an external apparatus 71 such as a PC or the like to the printer 1. In particular, it is possible to use a network card, a USB device controller or the like which is publicly known.

The reading device 65 may be a controller for reading various data stored in an external memory 72 such as a portable storage (e.g. a memory card or the like), a digital camera, etc. In particular, it is possible to use a memory controller, a USB host controller or the like which is publicly known.

The operating panel 66 includes a display, and various manual operation buttons for a user to operate. The user can operate on the operating panel 66 to input various instructions to the printer 1.

The control device 50 includes a CPU (Central Processing Unit), ROM (Read Only Memory), RAM (Random Access Memory), and various control circuits including ASIC and the like. The control device 50 performs various processes such as a recording control process, an image data acquisition process, a mode information acquisition process, a determination process, etc., according to various programs stored in the memory devices such as the ROM, RAM and the like. Further, the control device 50 is not limited to this hardware configuration but, for example, may have either one or a plurality of CPUs.

The recording control process is a process to control the operations of the driver IC 61 for driving the ink-jet head 3, the carriage motor 62 for moving the carriage 2, the transport motor 63 for driving the paper transport rollers 4, and the like, when the printer 1 performs image recording. The control device 50 causes the printer 1 to perform image recording selectively in any recording mode among aftermentioned first to fourth recording modes by controlling the driver IC 61, carriage motor 62, transport motor 63, and the like.

The image data acquisition process is a process to acquire image data sent from the external apparatus 71 such as a PC or the like to the printer 1. The control device 50 may acquire the image data via the aforementioned receiving device 64. For example, if the user has inputted an instruction to print a desired electric file, the external apparatus 71 such as a PC or the like creates an image data printable by the printer 1, and sends that image data to the printer 1. Further, the image data may be either a data described in a page description language or an image file data in a predetermined format such as JPEG or the like readable by the printer 1.

The mode information acquisition process is a process to acquire mode information indicating a recording mode, among the aftermentioned first to fourth recording modes, in which the image recording is to be performed on the recording paper P. The control device 50 may acquire the mode information via the aforementioned receiving device 64. Further, if the printing instruction is issued by the external apparatus 71 such as a PC or the like, the mode information in the embodiment may be a data created by a printer driver of the external apparatus 71. Then, the external apparatus 71 sends the mode information along with the aforementioned image data to the printer 1. The mode information acquired by the control device 50 may be either a data described in a page description language or a data described in the header of the image file in a predetermined format such as JPEG or the like.

It is also possible for the printer driver of the external apparatus 71 to generate the mode information indicating the recording mode in which the printing is to be performed, in accordance with various print settings and the file format of the original electric file. For example, it is possible to enable the user to select a desired recording mode from the first to fourth recording modes by GUI of the printer driver, and let the printer driver generate the mode information based on the user's selection. The user can directly set a preferred recording mode among the first to fourth recording modes.

Alternatively, the user may not directly set the first to fourth recording modes, but let the printer driver generate the mode information for the first to fourth recording modes based on other print setting items inputted by the user. For example, by GUI of the printer driver, it may be possible for the user to select with respect to two items such as "black-and-white/color setting" and "low resolution/high resolution setting". In the "black-and-white/color setting" item, one of "black-and-white print" and "color print" may be selectable. In the "low resolution/high resolution setting" item, one of "low resolution print" and "high resolution print" may be selectable.

Subsequently, if "black-and-white print" is set, the printer driver may generate the mode information indicating the third recording mode. Further, if "color print" and "low resolution print" are set, the printer driver may generate the mode information indicating the fourth recording mode. If "color print" and "high resolution print" are set, the printer driver may generate the mode information indicating either the first recording mode or the second recording mode based on the file format of the original electric file under the printing instruction. More specifically, if the file format is made by some spreadsheet software, word processing software or the like using thin lines such as ruled lines and the like, the printer driver may generate the mode information indicating the first recording mode. On the other hand, if the original electric file has an image file format such as TIFF, GIF or the like, the printer driver may generate the mode information indicating the second recording mode.

The determination process is a process to determine the recording mode among the aftermentioned first to fourth recording modes, in which image recording is to be performed by the printer 1 on the recording paper P, based on the mode information acquired in the mode information acquisition process. The determination process will be described in detail hereinafter.

Figure 4A:
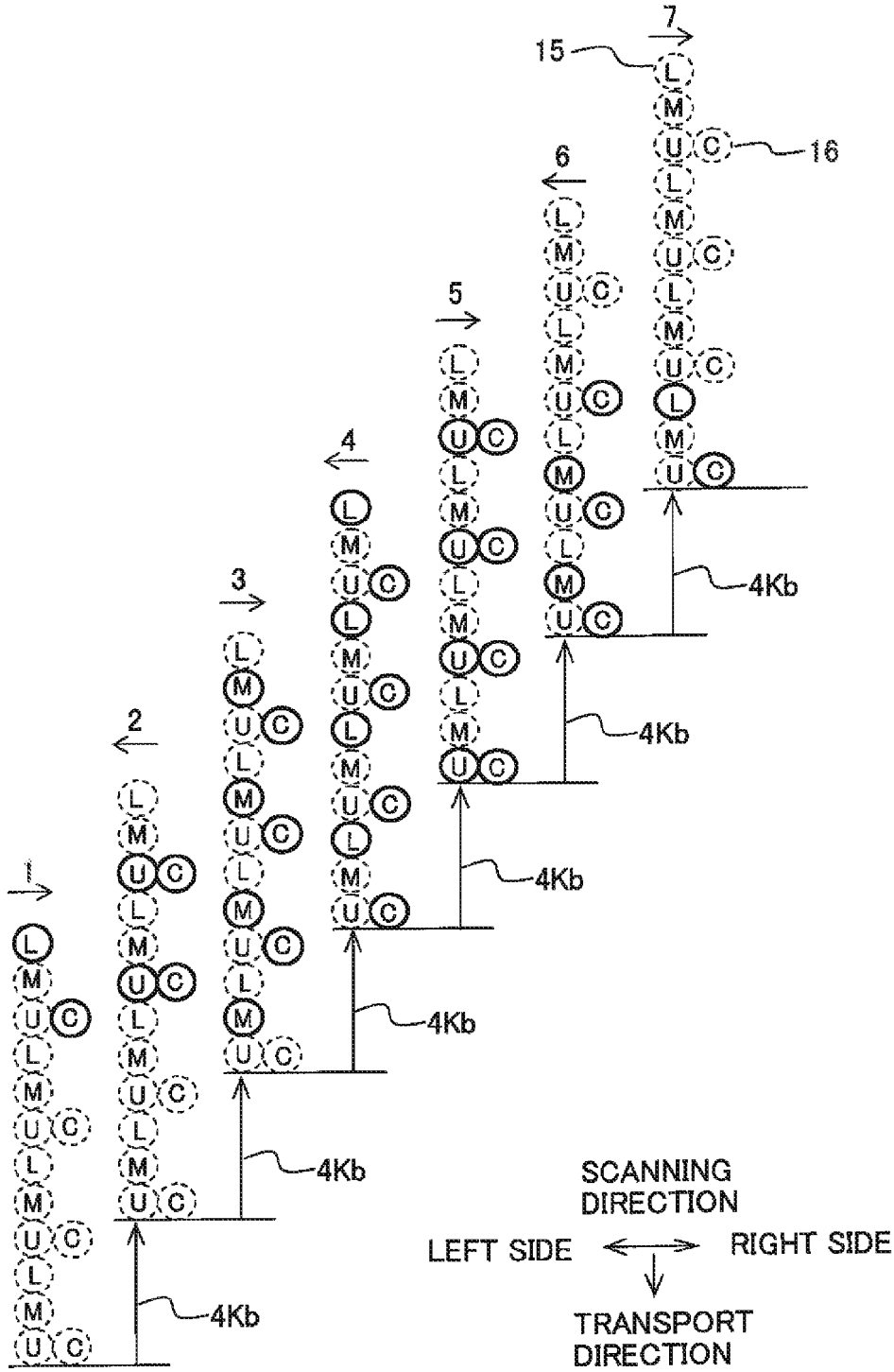
FIG. 4A shows the nozzles for jetting ink droplets.

The following explanation will be made for image recordings in the aforementioned first to fourth recording modes. The first recording mode is a recording mode in which color image recording at high resolution is performed by using both the black ink and the color inks. FIG. 4A schematically shows the nozzles 15 and 16 for jetting the inks, and a positional relationship between the black nozzles 15 and the color nozzles 16 in an aftermentioned first unit recording operations performed in the first recording mode. In FIG. 4A, the encircled "U", "M", and "L" correspond respectively to the black nozzles 15 of the black head units 11*a* to 11*c*, while the encircled "C" corresponds to the color nozzles 16 of the three color head units 12*a* to 12*c*. Further, the numerals 1 to 7 on the upper side in FIG. 4A show the number of times the first unit recording operation is performed, while the arrows below these numerals show the movement directions of the carriage 2 in each of the first unit recording operations. That is, in two successive performances of the first unit recording operation, the movement directions of the carriage 2 are opposite in the scanning direction. Further, FIG. 4A uses solid lines to show the nozzles 15 and 16 from which the ink droplets are jetted in each of the first unit recording operations, and uses broken lines to show the nozzles 15 and 16 from which the ink droplets are not jetted in each of the first unit recording operations.

Figure 4B:
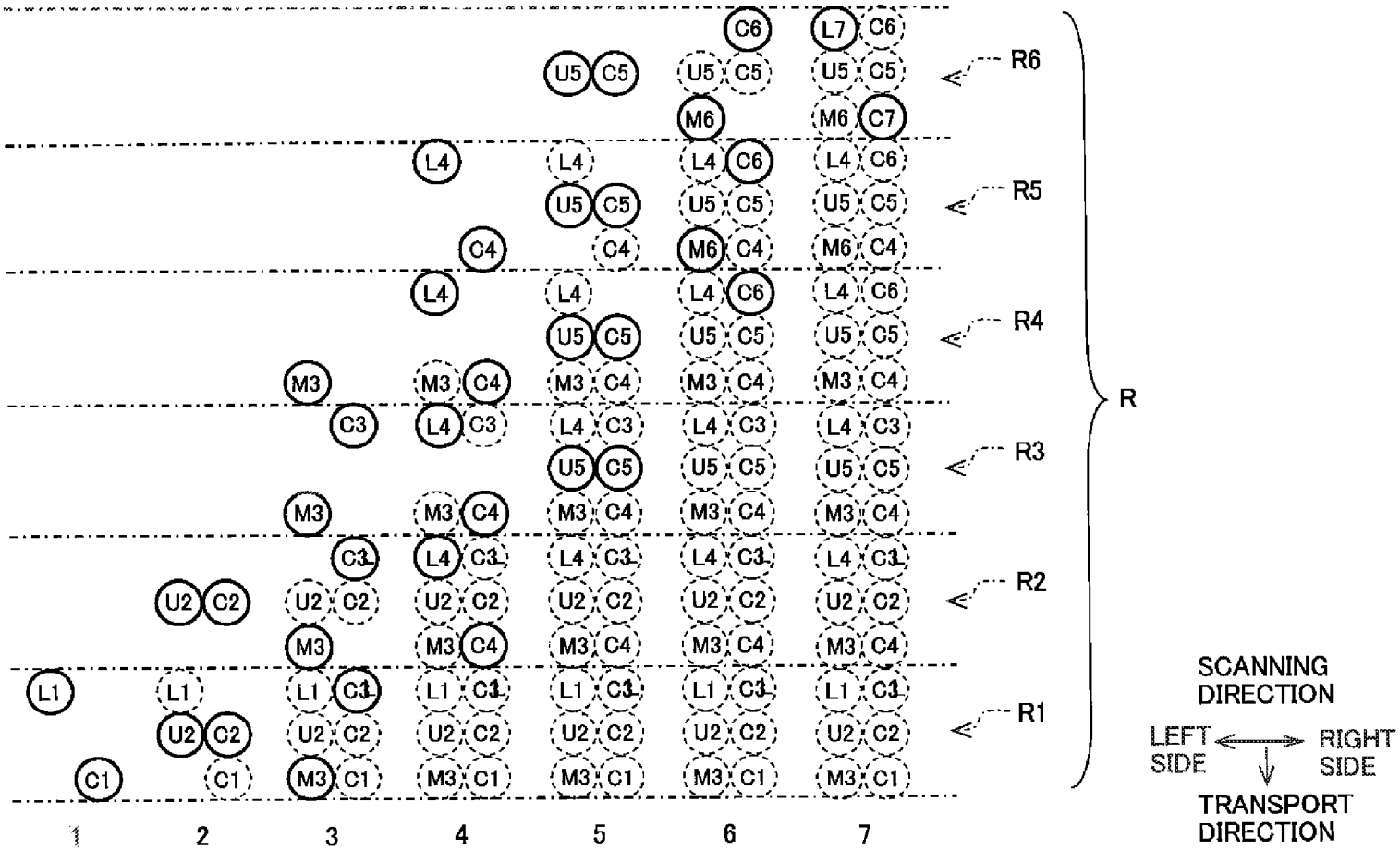
FIG. 4B shows landing positions of the ink droplets when image recording is performed in a first recording mode.

FIG. 4B schematically shows a landing condition of ink droplets when image recording is performed in the first recording mode. In FIG. 4B, the encircled "U", "M", and "L" correspond respectively to the landed ink droplets which are jetted from the black nozzles 15 of the black head units 11*a* to 11*c*, while the encircled "C" corresponds to the landed ink droplets which are jetted from the color nozzles 16 of the color head units 12*a* to 12*c*. Further, the numerals beside the "U", "M", "L" and "C" show the number of times the aftermentioned first unit recording operation is performed at the time when the ink droplets are landed. Further, the numerals 1 to 7 on the lower side in FIG. 4B show after the number of times the first unit recording operation is performed. Further, the solid lines are used to show the landing positions of the ink droplets in each of the first unit recording operations, while the broken lines are used to show the landing positions of the ink droplets which have already landed so far. In FIG. 4B, although the landing positions of black ink droplets and the landing positions of color ink droplets are shown as aligned in the scanning direction, depending on the recording image, the black ink droplets and the color ink droplets may land at positions overlapping each other, or land at positions deviating from each other in the scanning direction.

Further, in the printer 1, the ink-jet head 3 actually does not change its position in the transport direction, and the recording paper P is transported in the transport direction. In FIGS. 4A and 4B, however, in order to make it easy to understand the landing positions of the ink droplets on the recording paper P, the position of the recording paper P is fixed, while the position of the ink-jet head 3 is shown with the recording paper P as a reference. Further, FIGS. 4A and 4B show a case in which image recording is performed in an area R of the recording paper P in which 18 dots are to be aligned in the transport direction, by performing the aftermentioned first unit recording operation seven times repeatedly.

In the first recording mode, the black nozzles 15 are classified into three groups "U", "M" and "L", depending on which of the three black head units 11*a* to 11*c* the black nozzles 15 belong to. Then, image recording is carried out on the recording paper P by performing the first unit recording operation repeatedly. The first unit recording operation is a series of operations of moving the carriage 2 in the scanning direction while jetting the ink droplets from the black nozzles 15 belonging to any one group of "U", "M" and "L" as well as from the color nozzles 16 of the three color head units 12*a* to 12*c* and, thereafter, transporting the recording paper P in the transport direction by the length of 4 Kb which is four times as long as the interval Kb, i.e. by the length of Kb+Kn which is obtained by adding the interval Kn to the interval Kb. However, in each of the first unit recording operations, among the aforementioned nozzles 15 and 16, the ink droplets are jetted only from the nozzles 15 and 16 within the area R in the transport direction.

Further, in the first unit recording operations, every time when the first unit recording operation is finished, the group of the black nozzles 15 for jetting the ink droplets is switched to the group of the black nozzles 15 arranged at the positions deviating by 2 Kb to the downstream side in the transport direction from the black nozzles 15 from which the ink droplets have been jetted in the last first unit recording operation. That is, when carrying out image recording on the recording paper P by performing the first unit recording operation repeatedly, each time the first unit recording operation is finished, the group of the black nozzles 15 for jetting the ink droplets is switched in the order of " . . . →'L'→'U'→'M'→'L'→'U'→'M'→ . . . ".

Thus, by performing the image recording in this manner, as is understood from FIGS. 4A and 4B, in each of the first unit recording operations, it is possible to land the ink droplets at positions deviating by the interval Kb in the transport direction from the landing positions of the ink droplets in the first unit recording operation which has been performed immediately before the current first unit recording operation. At this time, if the area R is divided into six areas R1 to R6 in each of which three dots are aligned in the transport direction, the black ink droplets and the color ink droplets jetted in three successive performances of the first unit recording operation land in each of the areas R1 to R6.

Then, by carrying out image recording in this manner, it is possible to record color images at a high resolution corresponding to the interval Kb in the transport direction. Further, if image recording is carried out in this manner, during the time of repeating the first unit recording operation three times, all of the black nozzles 15 have a chance to jet the black ink droplets. Therefore, it is possible to prevent the black ink from drying in all of the black nozzles 15.

Figure 5A:
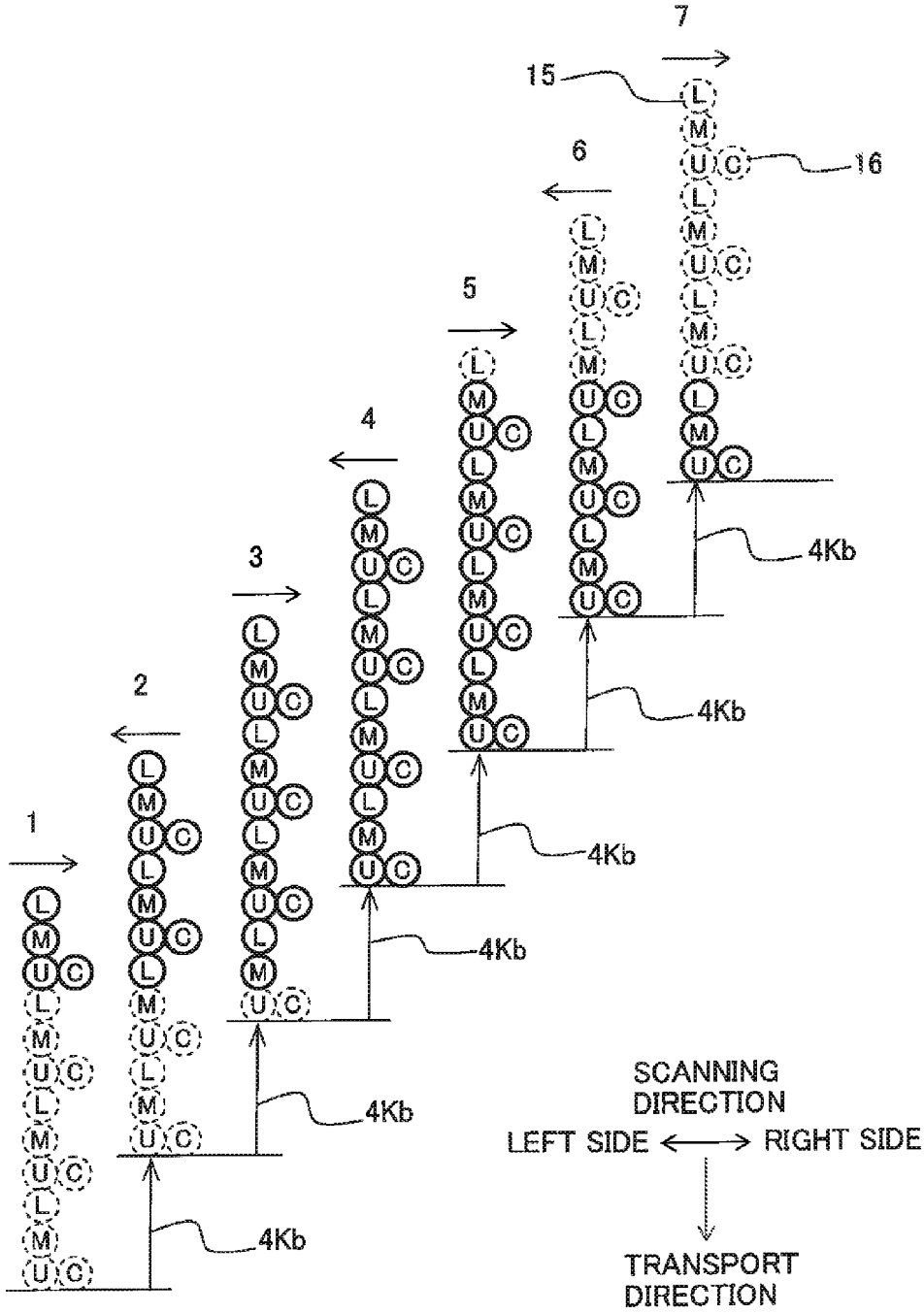
FIG. 5A shows the nozzles for jetting ink droplets.

The second recording mode is a recording mode which differs from the first recording mode, but also in which color image recording at high resolution is performed by using both the black ink and the color inks. Similar to FIG. 4A, FIG. 5A schematically shows the nozzles 15 and 16 for jetting the inks, and a positional relationship between the black nozzles 15 and the color nozzles 16 in aftermentioned second unit recording operations performed in the second recording mode. The numerals 1 to 7 on the upper side in FIG. 5A show the number of times the second unit recording operation is performed, while the arrows below these numerals show the movement directions of the carriage 2 in each of the second unit recording operations. That is, in two successive performances of the second unit recording operation, the movement directions of the carriage 2 are also opposite in the scanning direction.

Figure 5B:
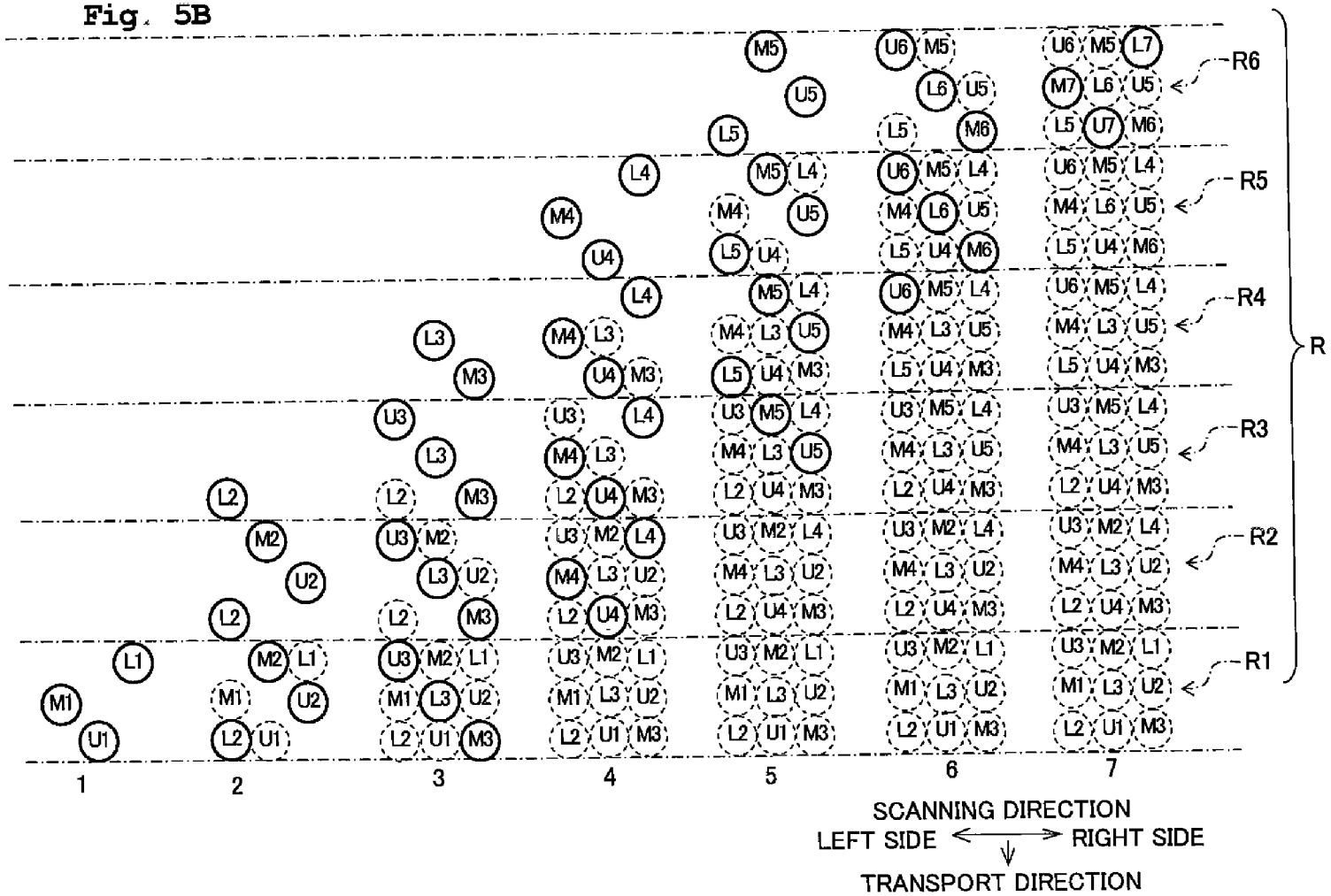
FIG. 5B shows landing positions of the ink droplets when image recording is performed in a second recording mode.

The FIG. 5B schematically shows a landing condition of black ink droplets when image recording is performed in the second recording mode. However, different from FIG. 4B, FIG. 5B shows an area in which three dots are aligned in the scanning direction as the area for landing the black ink droplets. Further, because there is no difference in landing positions of the color ink droplets between the first recording mode and the second recording mode, illustration of the landing positions of the color ink droplets is omitted in FIG. 5B.

In the second recording mode, image recording is carried out on the recording paper P by performing the second unit recording operation, repeatedly. The second unit recording operation is a series of operations of moving the carriage 2 in the scanning direction while jetting the ink droplets from the color nozzles 16 of the color head units 12*a* to 12*c* as well as from the black nozzles 15 belonging to every group of "U", "M" and "L" with a jetting period as long as one third of a jetting period of the color ink droplets from the color nozzles 16 and, thereafter, transporting the recording paper P in the transport direction by the length of 4 Kb which is four times the interval Kb, i.e. by the length of Kb+Kn which is obtained by adding the interval Kn to the interval Kb. However, at this time, among the nozzles 15 and 16, the inks are jetted only from nozzles 15 and 16 within the area R in the transport direction. Further, at this time, in the second unit recording operations, the ink droplets are landed at positions deviating in the scanning direction from the landing positions of the ink droplets in the second unit recording operation which has been performed immediately before the current second unit recording operation. Also at this time, the ink droplets jetted in three successive performances of the second unit recording operation land in each of the areas R1 to R6.

Then, as is understood from FIGS. 5A and 5B, by carrying out image recording in this manner, in analogy with the first recording mode, it is possible to record color images at a high resolution corresponding to the interval Kb in the transport direction. Further, if image recording is carried out in this manner, in each of the second unit recording operations, all of the black nozzles 15 have a chance to jet the black ink droplets. Therefore, it is possible to prevent the black ink from drying in all of the black nozzles 15.

Figure 6:
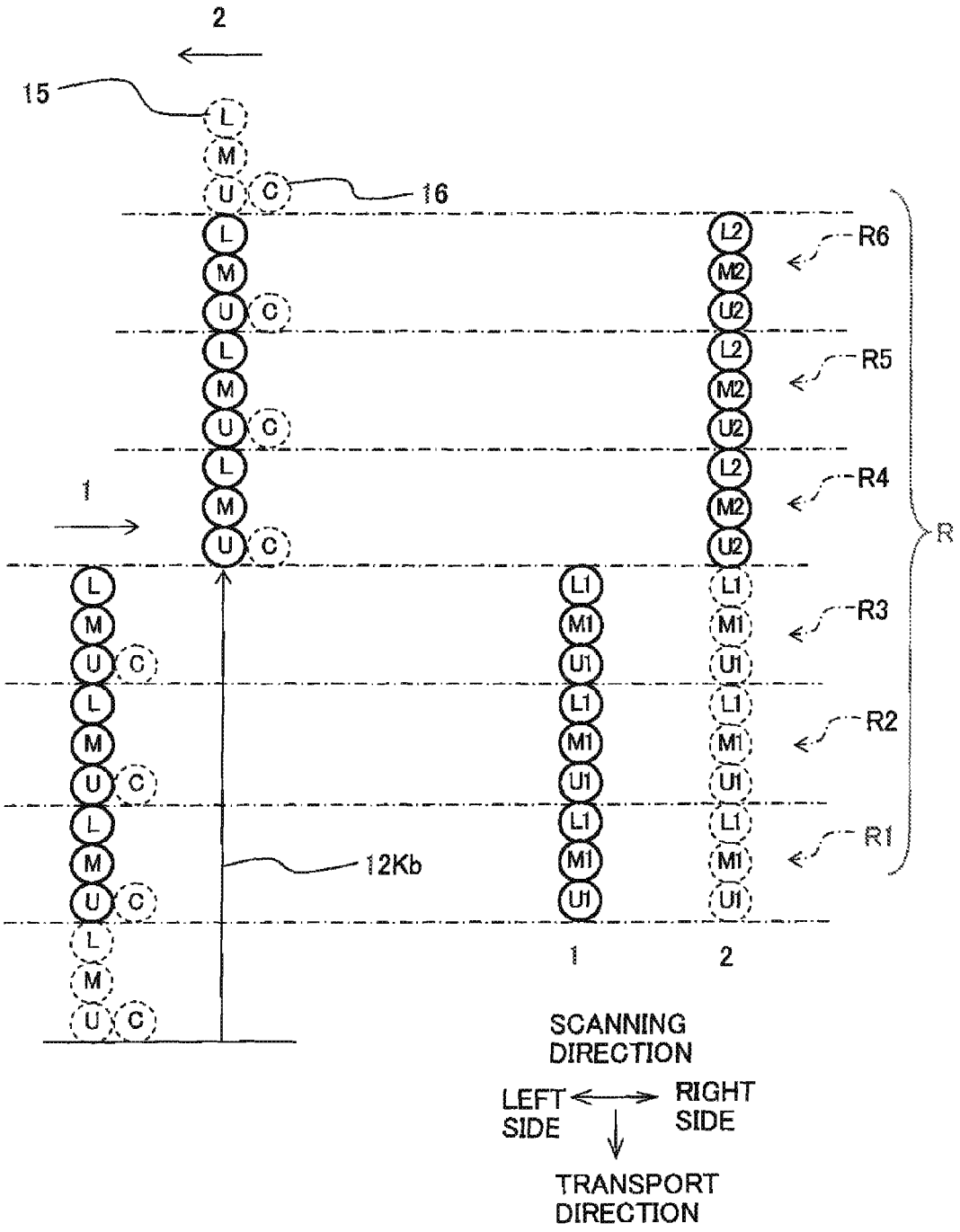
FIG. 6 shows the nozzles for jetting ink droplets and landing positions of the ink droplets when image recording is performed in a third recording mode.

The third recording mode is a recording mode in which black-and-white image recording at high resolution is performed by using only the black ink. Similar to FIG. 4A, the left part of FIG. 6 schematically shows the nozzles 15 and 16 for jetting the ink droplets, and a positional relationship between the black nozzles 15 and the color nozzles 16 in aftermentioned third unit recording operations. Similar to FIG. 4B, the right part of FIG. 6 schematically shows a landing condition of black ink droplets when image recording is performed in the third recording mode.

In the third recording mode, image recording is carried out on the recording paper P by performing the third unit recording operation repeatedly. The third unit recording operation is a series of operations of moving the carriage 2 in the scanning direction while jetting the black ink droplets from the black nozzles 15 belonging to every group of "U", "M" and "L" with the same jetting period as the jetting period of the color ink droplets from the color nozzles 16 in the second recording mode and, thereafter, transporting the recording paper P in the transport direction by the length of 12 Kb which is 12 times as long as the interval Kb, i.e. by the row length of the black nozzles 15 in the black head unit 11*c*. However, at this time, among the black nozzles 15, the ink droplets are jetted only from the black nozzles 15 within the area R in the transport direction.

Then, in the third recording mode, as is understood from FIG. 6, when recording black-and-white images, by performing the third unit recording operation twice, it is possible to carry out image recording in the same area R as in the first and second recording modes at the same resolution as the resolutions for recording in the first and second recording modes. That is, it is possible to record black-and-white images at the same resolution as that in the first and second recording modes and at a higher speed than that in the first and second recording modes. Further, in this case, the ink droplets jetted in the third unit recording operation for the first time land in the areas R1 to R3, while the ink droplets jetted in the third unit recording operation for the second time land in the areas R4 to R6.

Figure 7:
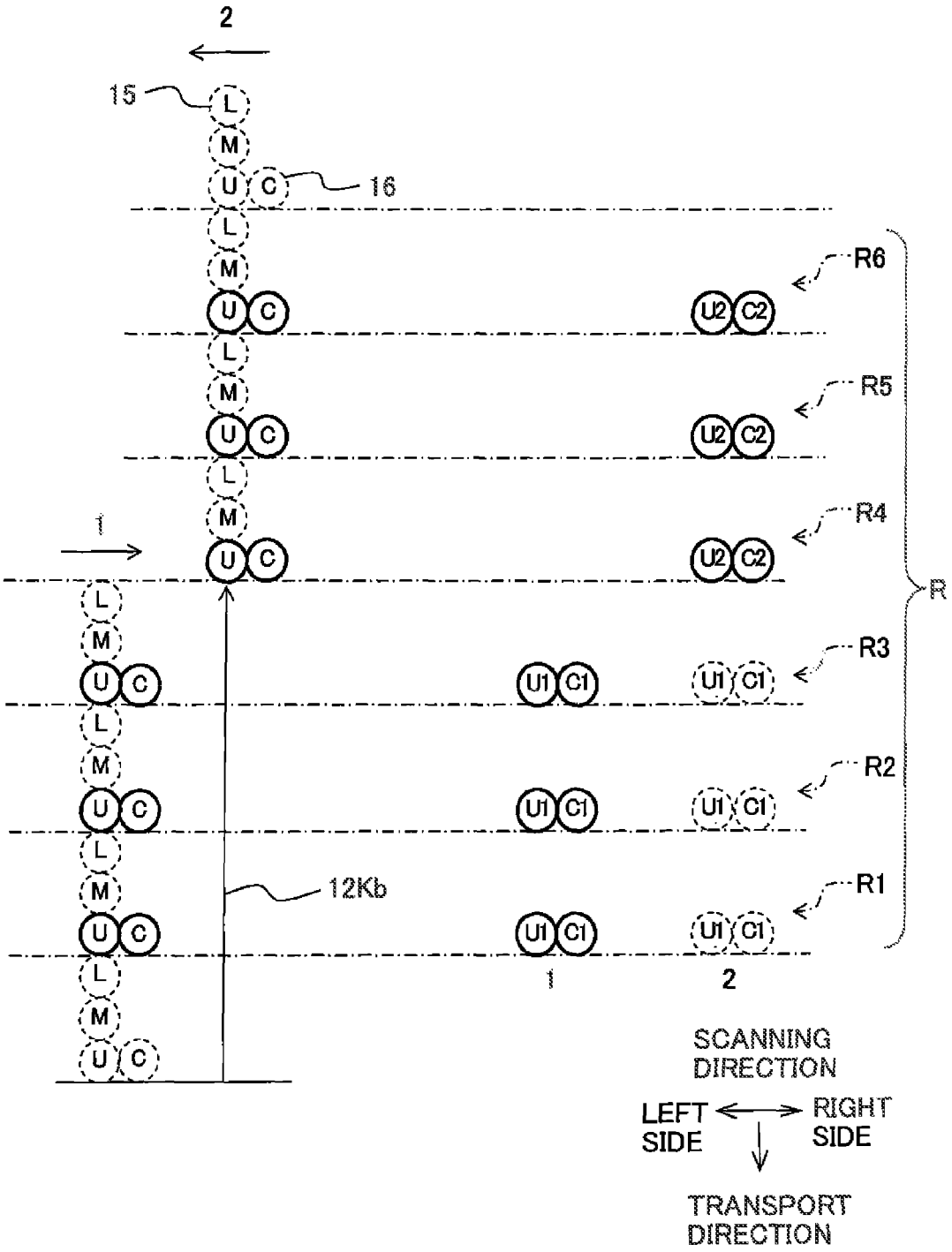
FIG. 7 shows the nozzles for jetting ink droplets and landing positions of the ink droplets when image recording is performed in a fourth recording mode.

The fourth recording mode is a recording mode in which image recording at a lower resolution than that in the first, to third recording modes is performed. Similar to FIG. 4A, the left part of FIG. 7 schematically shows the nozzles 15 and 16 for jetting the ink droplets, and a positional relationship between the black nozzles 15 and the color nozzles 16 in aftermentioned fourth unit recording operations. Similar to FIG. 4B, the right part of FIG. 7 schematically shows a landing condition of ink droplets when image recording is performed in the fourth recording mode.

In the fourth recording mode, image recording is carried out on the recording paper P by performing the fourth unit recording operations repeatedly. The fourth unit recording operation is a series of operations of moving the carriage 2 in the scanning direction while jetting the ink droplets from the color nozzles 16 as well as from the black nozzles 15 of the black head unit 11*c* arranged at the same height in the transport direction as the color nozzles 16 with the same jetting period as the jetting period of the color ink droplets from the color nozzles 16 and, thereafter, transporting the recording paper P in the transport direction by the length of 12 Kb which is 12 times as long as the interval Kb, i.e. by the row length of the black nozzles 15 in the black head units 11*a* to 11*c*. However, at this time, among the nozzles 15 and 16, the inks are jetted only from nozzles 15 and 16 within the area R in the transport direction.

Then, in the fourth recording mode, by performing the fourth unit recording operation twice, it is possible to carry out image recording in the same area R in the first and second recording modes at a lower resolution than the resolutions in the first and second recording modes. That is, it is possible to carry out image recording at a lower resolution than the resolutions in the first and second recording modes and at a higher speed than that the speed in the first and second recording modes. Further, in this case, the ink droplets jetted in the fourth unit recording operation for the first time land in the areas R1 to R3, while the ink droplets jetted in the fourth unit recording operation for the second time land in the areas R4 to R6.

Further, the explanation made here concerns the case of recoding color images by jetting the ink droplets from both the black nozzles 15 and the color nozzles 16. However, in the fourth recording mode, it is also possible to record black-and-white images at low resolution by jetting the ink droplets only from the black nozzles 15 of the black head unit 11*c*.

Further, in the embodiment, among the three black head units 11*a* to 11*c*, the black head unit 11*c* is closest to the color head units 12*a* to 12*c* in the scanning direction, and the black nozzles 15 of the black head unit 11*c* are arranged at the same positions as the color nozzles 16 in the transport direction. Further, in the fourth recording mode, image recording is carried out by jetting the ink droplets from the color nozzles 16, and the black nozzles 15 of the black head unit 11*c*. Therefore, compared with the case of carrying out image recording by jetting the ink droplets from the color nozzles 16, and the black nozzles 15 of the black head unit 11*a* or the black head unit 11*b*, it is possible to narrow the necessary movement range of the carriage 2 for image recording. By virtue of this, it is possible to carry out image recording at a higher speed.

As described above, the printer 1 can carry out image recording selectively in any recording mode of the first to fourth recording modes, and color images are recorded at the same resolution in the first recording mode and the second recording mode.

The following explanation will be made on a difference in image quality between an image recorded in the first recording mode and the image recorded in the second recording mode. In order to elucidate this difference in image quality, as shown in FIGS. 8A and 8B for example, the explanation will concern a case of recording a straight line T formed by letting a plurality of sets of three dots aligned in the scanning direction be aligned in the transport direction on the recording paper P.

Figure 8A:
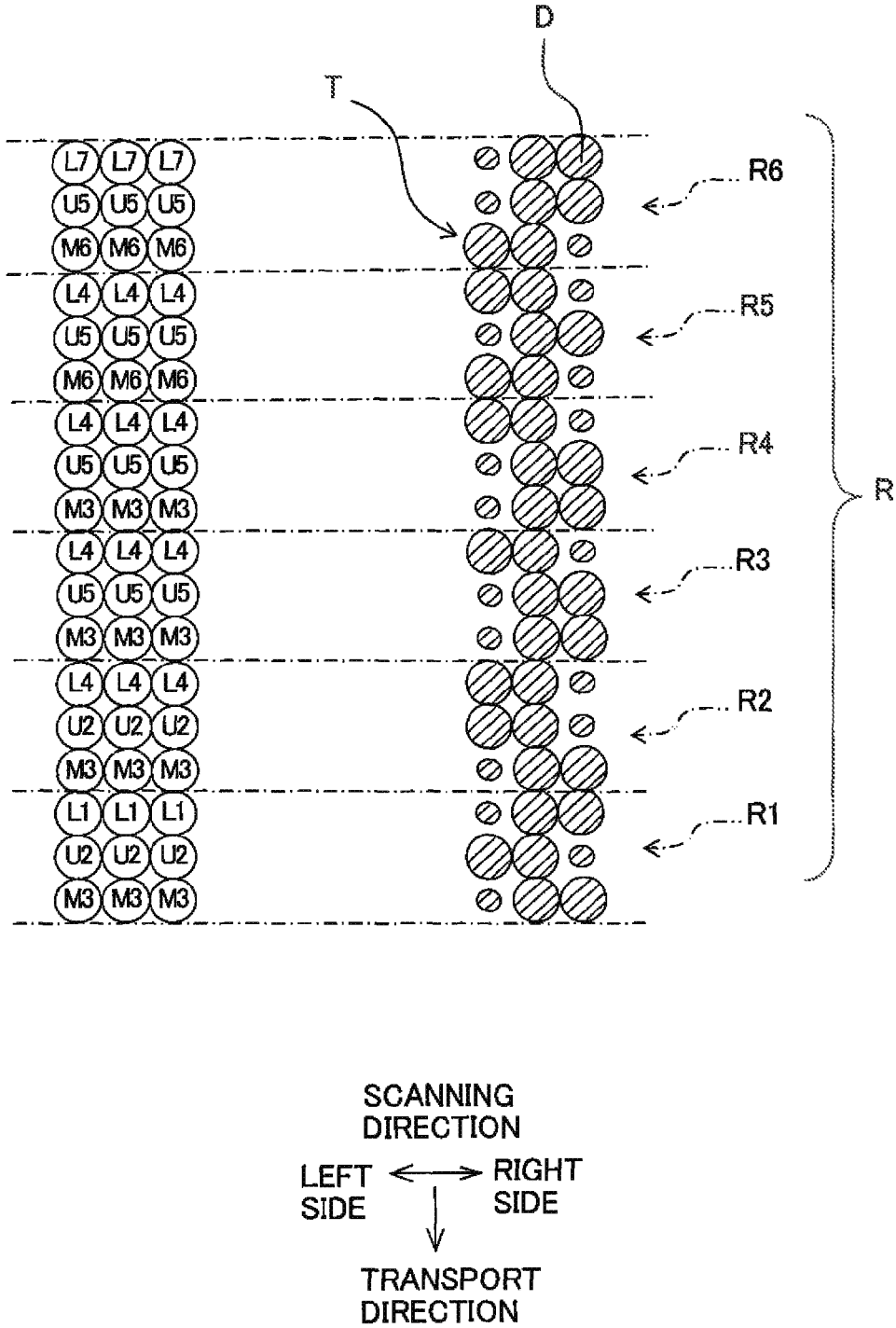
FIG. 8A shows landing positions of the ink droplets when a straight line extending in a transport direction is recorded in the first recording mode.
Figure 8B:
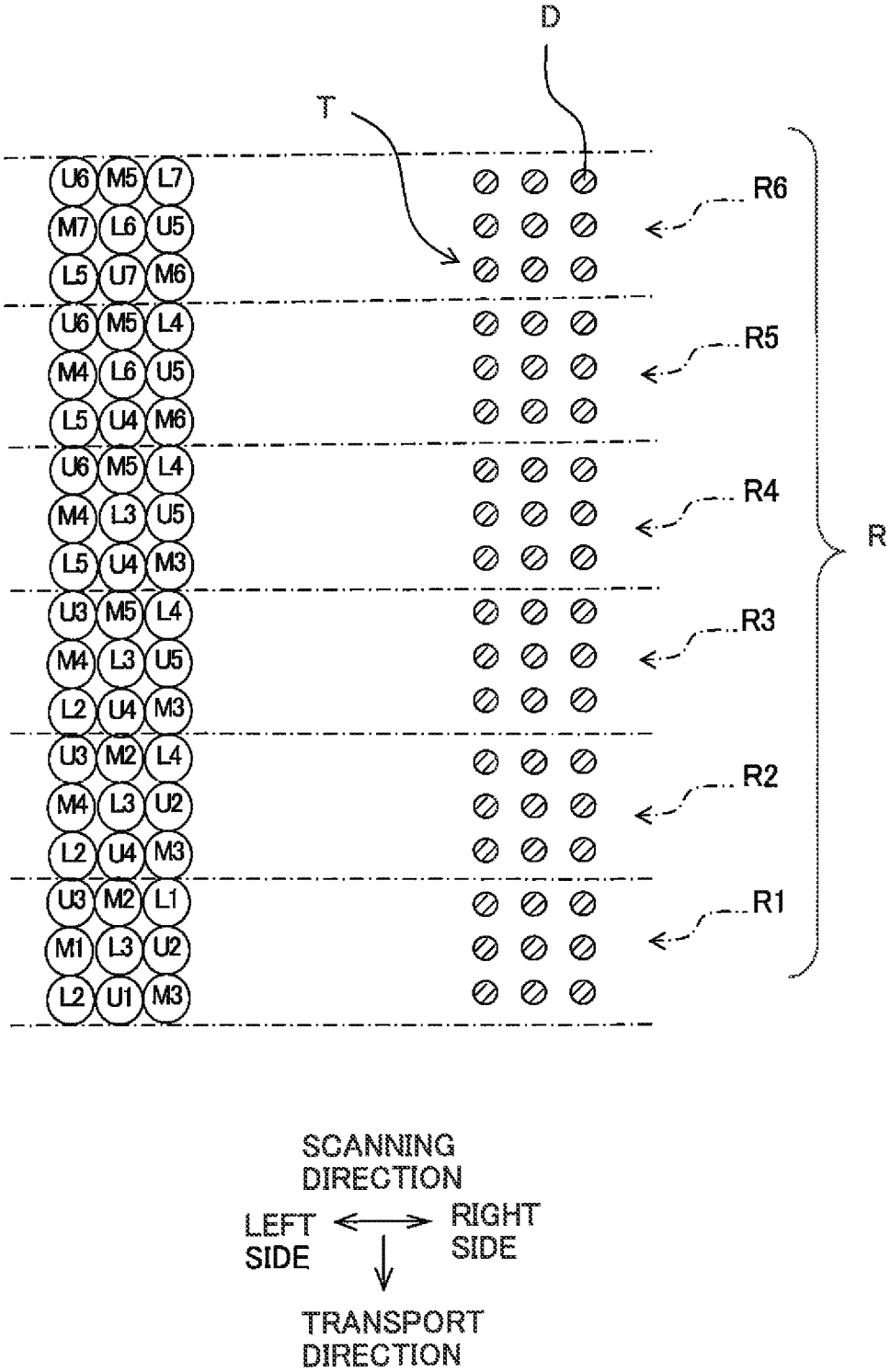
FIG. 8B shows landing positions of the ink droplets when a straight line extending in the transport direction is recorded in the second recording mode.

FIG. 8A shows the case of recording the line T in the first recording mode, wherein the left part of FIG. 8A is a schematic diagram showing landing positions of the ink droplets in the first unit recording operation, and the right part of FIG. 8A shows the sizes of the dots forming the recorded line T. On the other hand, FIG. 8B shows the case of recording the line T in the second recording mode, wherein the left part of FIG. 8B is a schematic diagram showing landing positions of the ink droplets in the second unit recording operation, and the right part of FIG. 8B shows the sizes of the dots forming the recorded line T.

When recording the line T in the first recording mode, as is understood from FIG. 8A, the sets of three dots D which are aligned in the scanning direction and constitute the line T are formed by the ink droplets jetted successively from the same black nozzles 15 in the same first unit recording operation.

At this time, among each set of three dots D, the dot D formed by the ink droplet jetted for the first time is formed by the ink droplet jetted from the black nozzle 15 which did not jet the ink droplet during at least one ink jetting period. Therefore, due to ink thickening in the black nozzle 15, the volume of the ink droplet becomes small, thereby reducing the size of the dot D formed by the ink droplet jetted for the first time. Here, among the sets of three dots D, the dots D formed by the ink droplets jetted for the first time are the leftmost dots D formed in each of odd-numbered time first unit recording operations in which the carriage 2 moves in the rightward direction, and the rightmost dots D formed in each of even-numbered time first unit recording operations in which the carriage 2 moves in the leftward direction.

In contrast to this, among those sets of three dots D, the dots D formed by the ink jetted for the second and third times are formed by the ink droplets jetted from the black nozzles 15 from which the ink droplets have been jetted at the first ink jetting period. Therefore, when the ink droplets are jetted from the black nozzles 15 to form these dots D, almost no ink thickening occurs in those black nozzles 15. Accordingly, the volume of the jetted ink droplets becomes larger, thereby increasing the size of the dots D.

In this manner, when recording the line T in the first recording mode, as is understood from FIG. 8A, the line T is recorded by the large and small dots D.

On the other hand, when recording the line T in the second recording mode, as is understood from FIG. 8B, among the dots D forming the line T, each set of three dots D aligned in the scanning direction is formed by the ink droplets jetted from the black nozzles 15 belonging to different groups in different performances of the second unit recording operation. That is, different from those in the first recording mode, these sets of three dots D are not formed by the ink droplets jetted successively from the same black nozzles 15.

Therefore, in this case, every dot D is formed by the ink droplet jetted from the black nozzles 15 which did not jet the ink droplet previously during at least one ink jetting period. Therefore, due to ink thickening in the black nozzles 15 until the current ink jetting, the volume of the ink droplet becomes smaller, thereby reducing the size of the dots D.

In this manner, when recording the line T in the second recording mode, as is understood from FIG. 8B, the line T is recorded by the small dots D only.

For the above reason, when recording the line T formed by letting a plurality of sets of dots D aligned in the scanning direction be aligned in the transport direction, if the line T is recorded in the first recording mode, it is recorded more darkly than it is recorded in the second recording mode.

Figure 9:
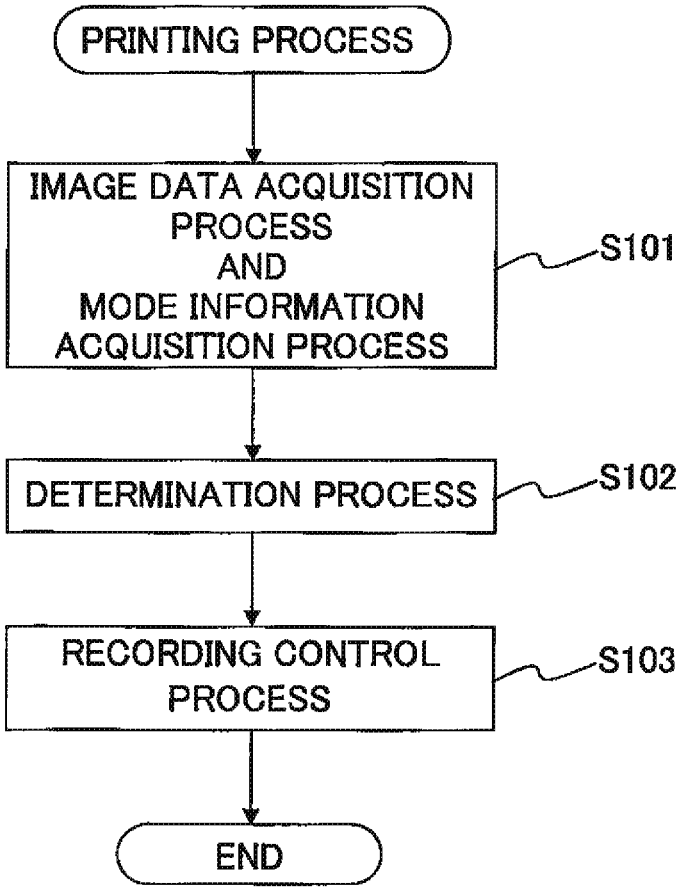
FIG. 9 is a flowchart showing a procedure of a printing process.

As described above, the printer 1 of the embodiment carries out image recording in any recording mode among the first to fourth recording modes. Referring to FIG. 9, the following explanation will be made on the operation of the control device 50 when receiving a recording instruction from the external apparatus 71.

If the receiving device 64 receives an instruction to record an image data, the control device 50 starts a printing process shown in FIG. 9. On starting the printing process, the control device 50 carries out the image data acquisition process, and the mode information acquisition process (S101). In S101, the control device 50 acquires the above image data and mode information via the receiving device 64.

After acquiring the image data and the mode information, the control device 50 carries out the determination process (S102). In the determination process, the control device 50 determines in which recording mode to record the image data based on the mode information acquired in S101. In particular, if the mode information acquired in S101 indicates the first recording mode, the control device 50 determines to record in the first recording mode. If the mode information acquired in S101 indicates the second recording mode, the control device 50 determines to record in the second recording mode. If the mode information indicates the third recording mode, the control device 50 determines to record in the third recording mode. If the mode information indicates the fourth recording mode, the control device 50 determines to record in the fourth recording mode.

After determining in which recording mode to record the image data the control device 50 carries out the recording in the recording mode determined in S102 (S103). Further, when receiving a plurality of divided image data under one printing instruction, the control device 50 acquires each of the image data in series and records the same in S103 repeatedly.

In the embodiment, it is possible to carry out image recording in any desired recording mode among the first to fourth recording modes. In the third recording mode, it is possible to record black-and-white images speedily at high resolution. Further, in the fourth recording mode, it is possible to record color or black-and-white images speedily at low resolution.

On the other hand, in the first recording mode, when recording a color image including straight lines extending in the transport direction at high resolution, it is possible to increase visibility of those lines. For example, the first recording mode is advantageous to printing a file with an image including a table for which some spreadsheet software or the like is used to form straight lines of the table such as ruled lines and the like extending in the transport direction, and it is presumed as preferable to highlight those straight lines for increasing their visibility. On the other hand, in the second recording mode, when the acquired file format imposes a heavy duty on jetting the ink droplets such as a photographic file format or the like, it is possible to prevent the black nozzles from drying so that a clear image can be recorded.

In the embodiment, the black nozzles 15 correspond to first nozzles according to the present invention, while the color nozzles 16 correspond to second nozzles according to the present invention. The paper transport rollers 4 correspond to a transport mechanism according to the present invention. Further, the interval Kb corresponds to a first interval according to the present invention, while the interval Kn corresponds to a second interval according to the present invention.

Next, explanations will be made with respect to a few modifications which apply various changes to the above embodiment. Note that, however, omission of explanation will be made as appropriate for the same components in terms of configuration as those in the above embodiment.

In the above embodiment, the control device 50 is explained as a device to acquire information directly indicating a recording mode itself as the mode information in S101. However, the present invention is not limited to this. For example, it is also allowable to make use of other information concerning print settings as the above mode information. In particular, as the mode information, it is possible to make use of information concerning the following three setting items: "black-and-white/color setting", "low resolution/high resolution setting", and "thin line setting". It is possible to enable a user to use GUI of a printer driver to appropriately perform these print settings, and let an external apparatus send the information of these print settings to the printer 1 along with the image data. The items "black-and-white/color setting" and "low resolution/high resolution setting" are the same as those explained hereinbefore. In the item of "thin line setting", it is possible to let one print setting of "highlight thin lines" and "prioritize images of photographs, etc." be selectable.

In this case, in the above S101, the control device 50 acquires information concerning these settings as the mode information via the above receiving device 64. Then, in S102, the control device 50 determines in which recording mode to carry out image recording based on the information received in S101. In particular, if the mode information acquired in S101 indicates the first recording mode, the control device 50 determines to record in the first recording mode. If the mode information acquired in S101 indicates the second recording mode, the control device 50 determines to record in the second recording mode. If the mode information indicates the third recording mode, the control device 50 determines to record in the third recording mode. If the mode information indicates the fourth recording mode, the control device 50 determines to record in the fourth recording mode. Further, "thin line setting" may also be an item which is not directly settable by the user. For example, a printer driver may set the "thin line setting" based on the format of the original image file under printing instruction.

In the above embodiment, the control device 50 is explained as a device to acquire information directly indicating a recording mode itself as the mode information. However, the present invention is not limited to this. For example, it is also allowable to make use of the image data itself as the mode information.

In this case, the control device 50 acquires only the image data in the above S101. Then, in S102, the control device 50 determines in which recording mode among the first to fourth recording modes to carry out image recording based on the image data acquired in S101. In particular, from the image data acquired in S101, the control device 50 determines: (i) whether the black-and-white image recording or the color image recording is suitable, (ii) whether the low-resolution recording or the high-resolution recording is suitable, and (iii) whether or not it is preferable to highlight the thin lines, etc., respectively. The determination (i) is carried out, for example, according to whether or not any non-black data are included in the image data. The determination (ii) is carried out, for example, based on the resolution of the received image. The determination (iii) is carried out, for example, according to whether or not there are any thin lines in the received image through pattern matching.

Further, in the above embodiment, the control device 50 is explained as a device to receive image data via the receiving device 64. However, the present invention is not limited to this. For example, it is also possible to acquire image data via the reading device 65 from the external memory 72 such as a memory card or the like which has stored an image file as the image data in a predetermined format printable by the printer 1. In this case, the control device 50 starts the aforementioned printing process when the user has inputted an instruction through the operating panel 66 to print the image data stored in the external memory 72 after connecting the external memory 72 to the reading device 65.

At this time, the control device 50 acquires the image data via the reading device 65 in S101. Further, the external memory 72 may not prestore the mode information. The operating panel 66 may be configured to accept user's mode selection on the screen for inputting printing instruction. Thus, the control device 50 acquires the mode information via the operating panel 66. Then, in S102 the control device 50 determines in which recording mode among the first to fourth recording modes to carry out image recording based on the mode information acquired via the operating panel 66, and in S103, the control device 50 carries out image recording in the recording mode determined in S102.

In the embodiment, the printer 1 is capable of directly accepting designation of a recording mode by the operating panel 66. However, the printer 1 may alternatively be capable of indirectly accepting designation of a recording mode by using other settings. Still alternatively, the printer 1 may automatically determine a recording mode by analyzing the image data acquired in S101 without accepting designation of any recording mode inputted by manipulation of the operating panel 66.

Figure 10A:
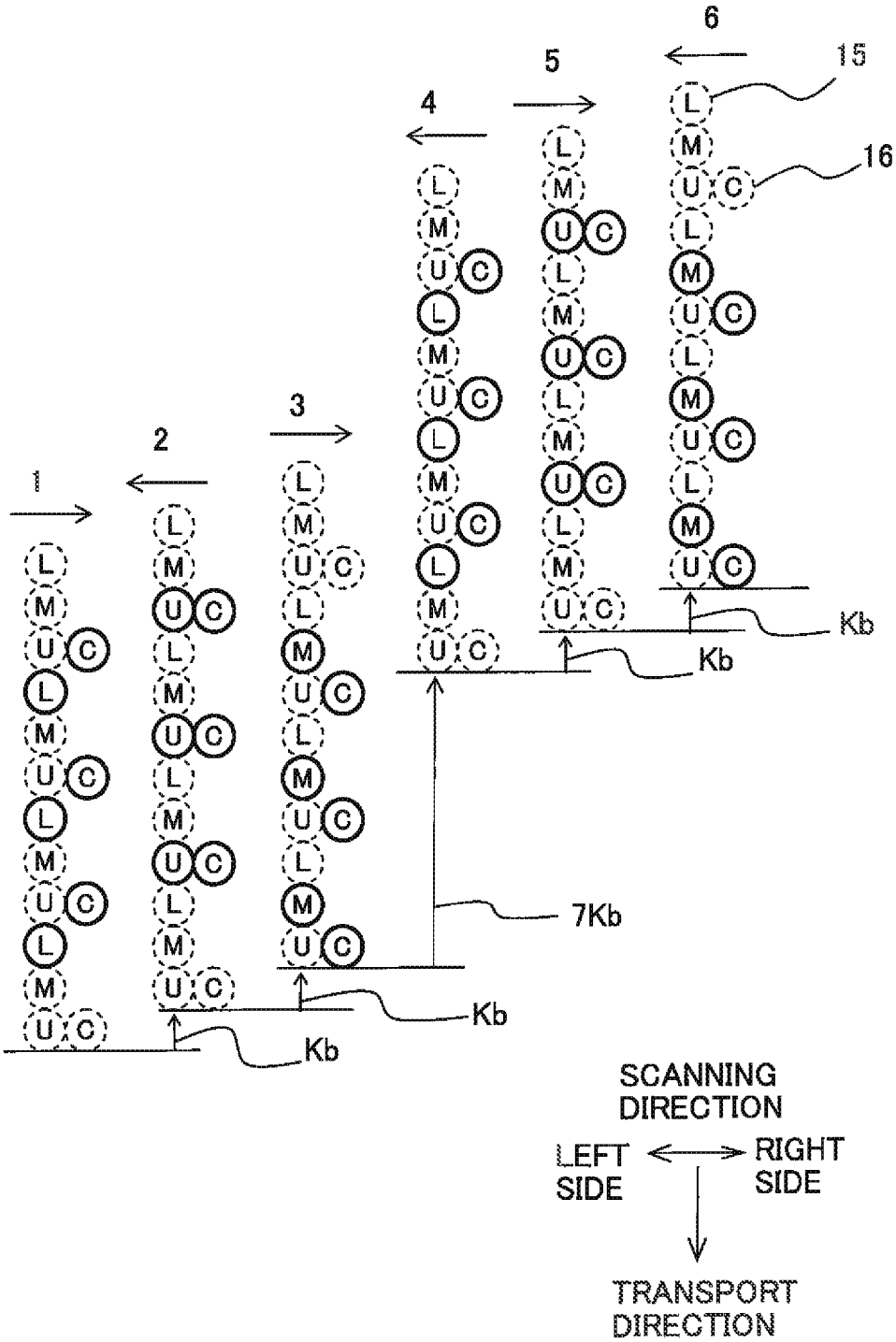
FIGS. 10A and 10B are diagrams corresponding to FIGS. 4A and 4B, respectively, according to a modification of the first recording mode.
Figure 10B:
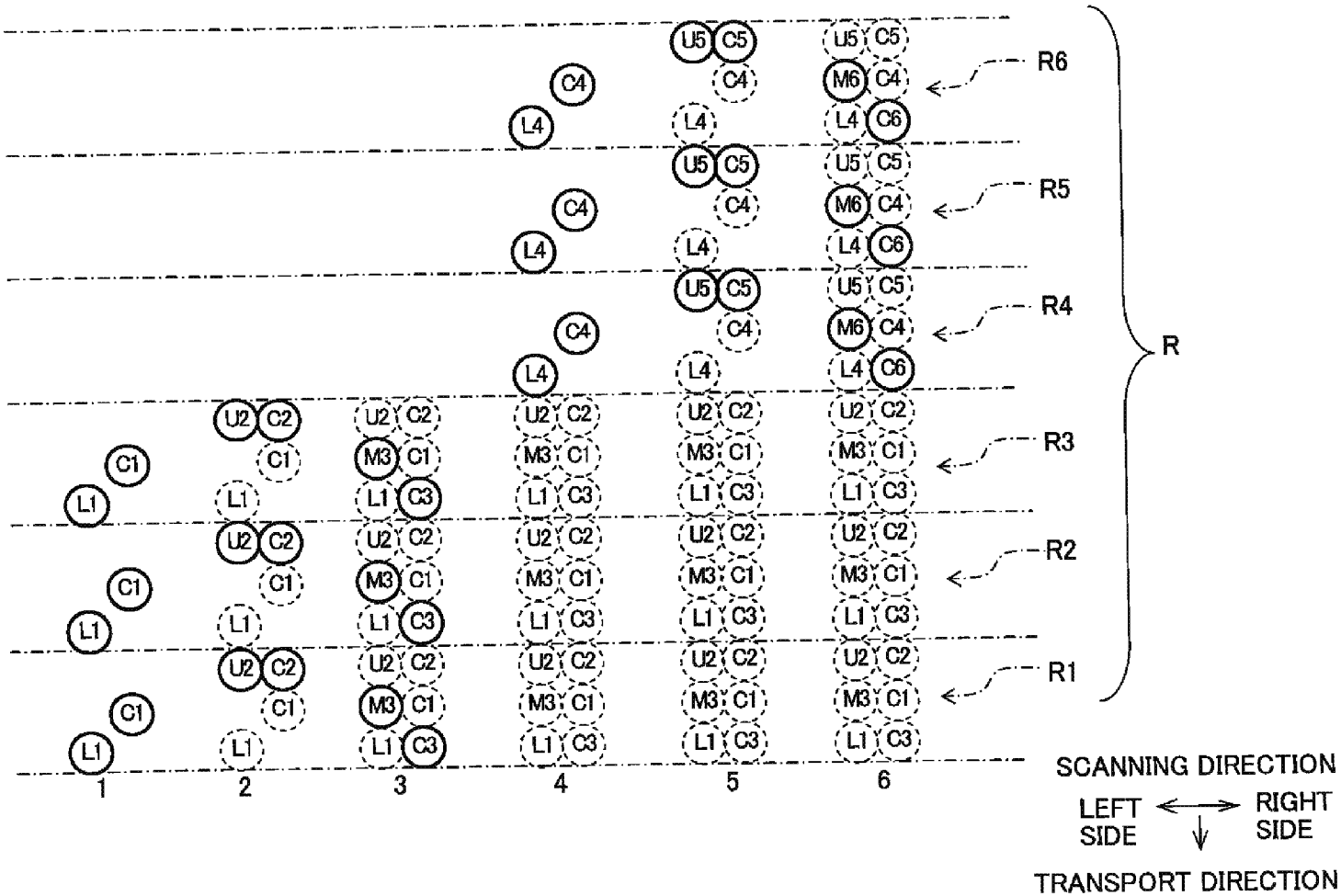

Further, in the above embodiment, although the recording paper P is transported by the length of 4 Kb at a time in the first unit recording operation and the second unit recording operation, the present invention is not limited to this. For example, as shown in FIGS. 10A and 10B, in the first unit recording operation for the first and second times as well as for the fourth and fifth times, the recording paper P may be transported by the same length as the interval Kb respectively, while in the first unit recording operation for the third time, the recording paper P is transported by the length of 7 Kb which is seven times as long as the interval Kb, in other words by the length Kb+2Kn which is obtained by adding twice the interval Kn to the interval Kb=. In this case, however, in the first unit recording operation for the first to third times, the inks are jetted only from the nozzles 15 and 16 within the areas R1 to R3, while in the first unit recording operation for the fourth to sixth times, the inks are jetted only from the nozzles 15 and 16 within the areas R4 to R6. Further, as shown in FIGS. 11A and 11B, in the second unit recording operation for the first and second times as well as for the fourth and fifth times, the recording paper P may be transported by the same length as the interval Kb respectively, while in the second unit recording operation for the third time, the recording paper P is transported by the length of 7 Kb which is seven times as long as the interval Kb, in other words by the length Kb+2Kn which is obtained by adding twice the interval Kn to the interval Kb.

In these cases, too, in the first recording mode, the dots aligned in the scanning direction are formed by the ink droplets jetted successively from the same black nozzles 15 in the same performance of the first unit recording operation. Further, in the second recording mode, the dots aligned in the scanning direction are formed by the ink droplets jetted in different performances of the second unit recording operation. Therefore, in the same manner as in the above embodiment, in the first recording mode, the line T is darkly recorded to extend in the transport direction, while in the second recording mode, the line T is lightly recorded.

Figure 11A:
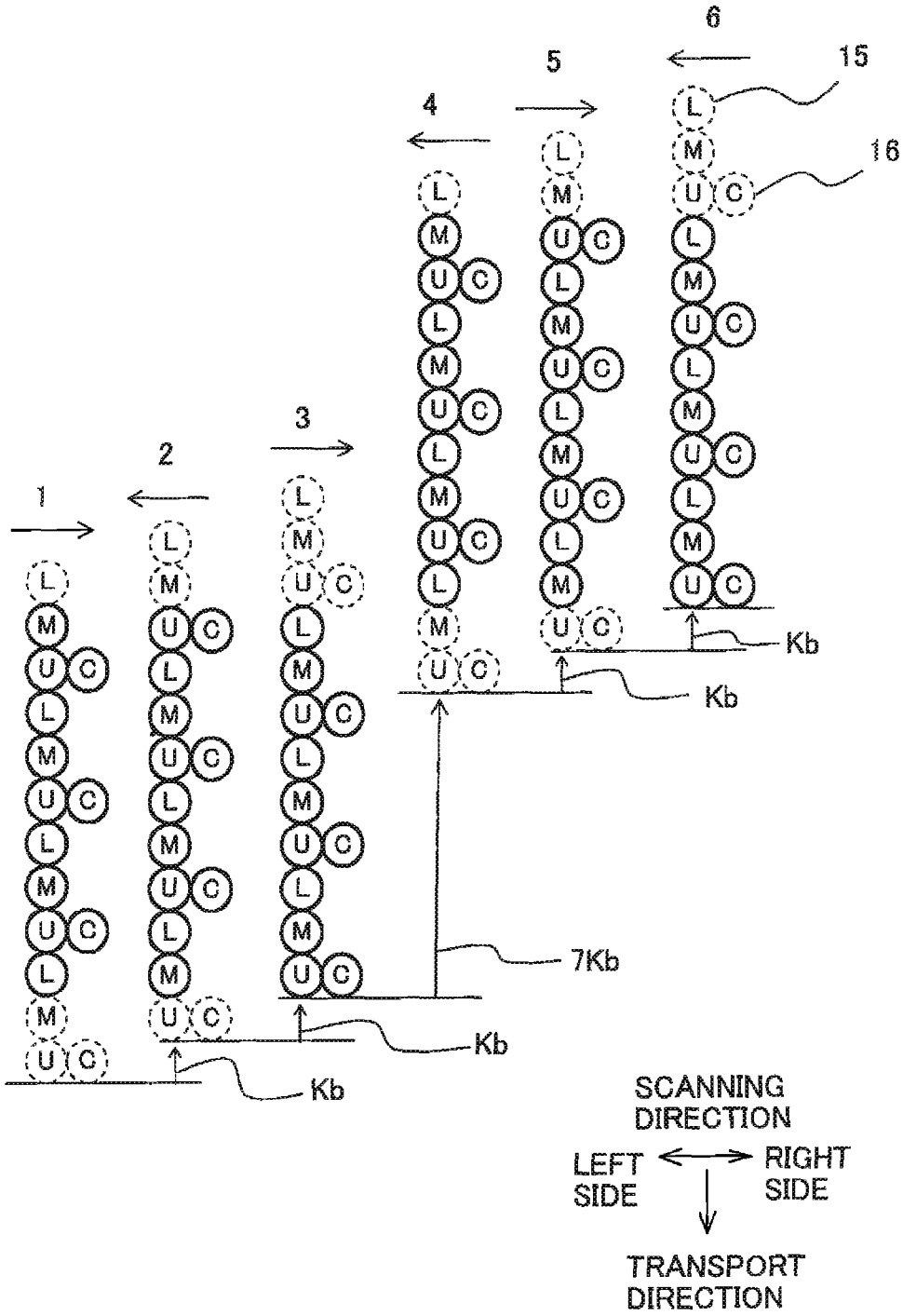
FIGS. 11A and 11B are diagrams corresponding to FIGS. 5A and 5B, respectively, according to a modification of the second recording mode.
Figure 11B:
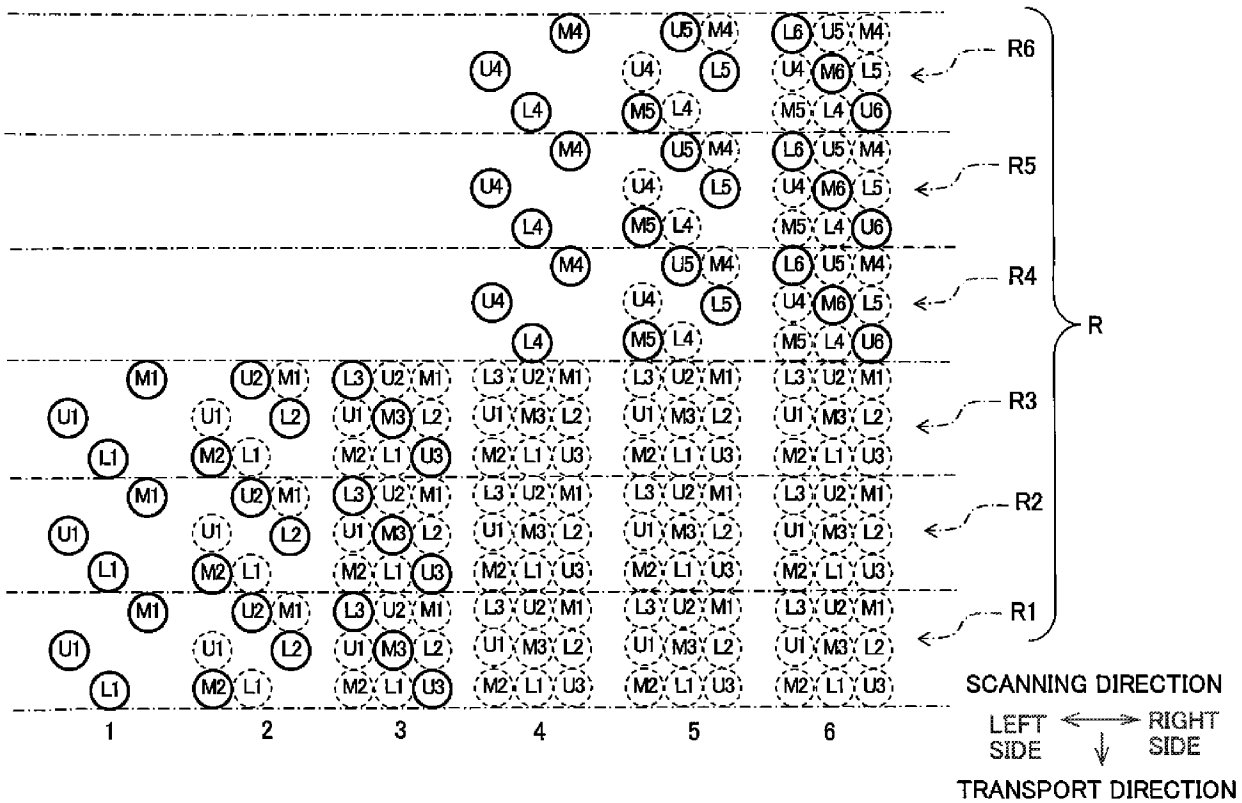

Further, in these modifications, as is understood from FIGS. 10A, 10B, 11A, an 11B, by repeating the first unit recording operation or the second unit recording operation six times, it is possible to carry out image recording in the same area R as that in the above embodiment.

Further, if the transport amount of the recording paper P in the first or second unit recording operation is one of the interval Kb or the length of the interval Kb plus an integral multiple of the interval Kn, the present invention is not limited to the modifications explained above.

Further, in the above embodiment, although the color nozzles 16 are arranged at the same position with respect to the transport direction as the black nozzles 15 of the black head unit 11*c*, the present invention is not limited to this. The color nozzles 16 may also be arranged at the same position with respect to the transport direction as the black nozzles 15 of the black head unit 11*a* or the black nozzles 15 of the black head unit 11*b*.

In these cases, when carrying out image recording in the first recording mode, if the group of the black nozzles 15 for jetting the ink droplets switches in the order of " . . . →'L'→'U'→'M'→'L'→'U'→'M'→ . . . " in the first unit recording operation for each time, it is possible to carry out the same image recording as in the above embodiment.

Further, in the above embodiment, although the interval Kn between the color nozzles 16 is three times as long as the interval Kb between the black nozzles 15, the present invention is not limited to this. The interval Kn between the color nozzles 16 may alternatively be an odd multiple of the interval Kb and not less than five times as long as the interval Kb between the black nozzles 15.

In this case, in the same manner as in the above embodiment, the black nozzles 15 are classified into an odd number of groups as indicated hereinbefore. Then, in each of the first unit recording operations, the ink droplets jetted from the black nozzles 15 belonging to one group and the color nozzles 16 and, the one group of the black nozzles 15 includes the black nozzles 15 arranged which are deviated by the length of 2 Kb to the downstream side in the transport direction from the black nozzles 15 for jetting the ink droplets in the first unit recording operation which has been performed immediately before. By virtue of this, the ink droplets jetted in each of the first unit recording operations land at positions deviating by the interval Kb in the transport direction from the landing positions of the ink droplets jetted in the first unit recording operation which has been performed immediately before. As a result, it is possible to record color images at a resolution corresponding to the interval Kb between the black nozzles 15.

Further, in this case, in the same manner as in the above embodiment, while the first unit recording operation is being repeated for the above odd number of times, all of the black nozzles 15 have a chance to jet the ink droplets, and hence it is possible to prevent the black nozzles 15 from drying. Further, in this case, in the same manner as in the above embodiment, it is possible to record the line T darkly.

Further, the above explanations are made with an example of applying the present invention to a printer including the ink-jet head 3 which has the black nozzles 15 for jetting the black ink and the color nozzles 16 for jetting the color inks. However, the present invention is not limited to this. Other combinations of ink types besides the black ink and the color inks are also possible between the type of ink or inks jetted from first nozzles aligned mutually at a predetermined first interval, and the type of ink or inks jetted from second nozzles aligned mutually at a predetermined second interval which is a predetermined odd multiple of the first interval and not less than three times as long as the first interval.

What is claimed is:

1. An image recording apparatus configured to perform recording an image on a recording medium by jetting a plurality of types of ink droplets, the apparatus comprising:

an ink-jet head having a plurality of nozzles and configured to jet the ink droplets from the nozzles;

a carriage configured to carry the ink-jet head, and reciprocate in a predetermined scanning direction;

a transport mechanism configured to transport the recording medium, on which the ink droplets jetted from the nozzles land, in a transport direction intersecting the scanning direction; and a control device configured to control the ink-jet head, the carriage and the transport mechanism to perform recording of the image, wherein the ink-jet head has, as the plurality of nozzles, a plurality of first nozzles which are aligned at first interval with respect to the transport direction and from which first-type ink droplets are jetted, and a plurality of second nozzles which are aligned at second interval with respect to the transport direction and from which second-type ink droplets different from the first-type ink droplets are jetted, the second interval being predetermined odd number times as long as the first interval and the predetermined odd number being not less than three, the first nozzles are divided into the predetermined odd number of nozzle groups each of which is constituted by some of the first nozzles aligned at the second interval in the transport direction, the control device is configured to perform recording of the image on the recording medium by performing a first unit recording operation for the predetermined odd number of times repeatedly, the first unit recording operation being a series of operations of jetting the ink droplets from the first nozzles constituting one nozzle group among the predetermined odd number of nozzle groups and from the second nozzles while moving the carriage in the scanning direction, and causing the transport mechanism to transport the recording medium by predetermined length, which is one of the length of the first interval and length obtained by adding an integral multiple of the second interval to the first interval, and in two successive performances of the first unit recording operation, after the first-type ink droplets are jetted in former first unit recording operation from a first nozzle group among the predetermined odd number of nozzle groups, the first-type ink droplets are jetted in latter first unit recording operation from a second nozzle group among the predetermined odd number of nozzle groups, the second nozzle group including the first nozzles arranged at positions which are deviated by twice the first interval to the downstream side in the transport direction from the first nozzles belonging to the first nozzle group, and landing positions of the first-type ink droplets jetted in the latter first unit recording operation are deviated by the first interval to the downstream side in the transport direction from landing positions of the first-type ink droplets jetted in the former first unit recording operation.

2. The image recording apparatus according to claim 1, wherein the control device is configured to control the carriage to move to one side in the scanning direction in the former first unit recording operation, and to move to the other side in the scanning direction in the latter first unit recording operation.

3. The image recording apparatus according to claim 1, wherein the control device is configured to further perform a second unit recording operation, the second unit recording operation being a series of operations of: jetting the second-type ink droplets from the second nozzles with second jetting period as well as jetting the first-type ink droplets from the first nozzles with first jetting period which is obtained by multiplying the second jetting period by reciprocal of the predetermined odd number, while moving the carriage in the scanning direction; and causing the transport mechanism to transport the recording medium by the predetermined length, and the control device is configured to perform recording of the image on the recording medium in one of a first recording mode in which recording of the image on the recording medium is carried out by performing the first unit recording operation for the predetermined odd number of times repeatedly, and a second recording mode in which recording of the image on the recording medium is carried out by performing the second unit recording operation for the predetermined odd number of times repeatedly.

4. The image recording apparatus according to claim 3, wherein in two successive performances of the second unit recording operation, the control device is configured to control the carriage to move to one side in the scanning direction in former second unit recording operation, and to move to the other side in the scanning direction in latter second unit recording operation.

5. The image recording apparatus according to claim 3, wherein the control device is further configured to:

acquire an image data of the image and mode information indicating a recording mode corresponding to the image data;

determine in which recording mode to carry out recording of the image on the recording medium from the first recording mode and the second recording mode based on the mode information; and record the image corresponding to the image data on the recording medium in the determined recording mode.

* * * * *